United States Patent [19]

Maudal et al.

[11] 4,351,499

[45] Sep. 28, 1982

[54] DOUBLE FABRIC, RETRACTABLE, SELF-ERECTING WING FOR MISSLE

[75] Inventors: Inge Maudal, Claremont; Larry D. Wedertz, Mira Loma; Kenneth M. Yost, Glendora, all of Calif.

[73] Assignee: General Dynamics, Pomona, Calif.

[21] Appl. No.: 77,966

[22] Filed: Sep. 24, 1979

[51] Int. Cl.[3] ..... F42B 13/32

[52] U.S. Cl. ..... 244/3.27

[58] Field of Search ..... 244/3.27, 3.28, 3.29

[56] References Cited

U.S. PATENT DOCUMENTS

| | | | |
|---|---|---|---|
| 1,339,188 | 5/1920 | Frecska | 244/3.27 |
| 2,959,143 | 11/1960 | Endrezze | 244/3.27 X |
| 3,633,846 | 1/1972 | Biggs, Jr. | 244/3.27 |
| 3,788,578 | 1/1974 | Sweeney et al. | 244/3.28 |
| 3,990,656 | 11/1976 | Minnich | 244/3.27 X |

FOREIGN PATENT DOCUMENTS

| | | | |
|---|---|---|---|
| 1203647 | 10/1965 | Fed. Rep. of Germany | 244/3.27 |

*Primary Examiner*—Harold J. Tudor

*Attorney, Agent, or Firm*—Neil F. Martin; Freling E. Baker; Edward B. Johnson

[57] ABSTRACT

A retractable, self-erecting wing for a low speed missile, having a double walled fabric body held in extended position by spring loaded struts, the fabric enclosing an air pocket which acts as a damper to prevent the wing from fluttering under certain aerodynamic conditions. The wing is extended by a hinged strut structure and folds into a very small space adjacent the outer wall of the missile body. The structure enables a large area wing to be stowed in a minimum of space so that the maximum internal volume is available for payload. In stowed condition the wing is completely enclosed in the body for minimum drag during any high speed portion of the missile flight, multiple wings being released when required by a simple mechanism.

14 Claims, 12 Drawing Figures

DOUBLE FABRIC, RETRACTABLE, SELF-ERECTING WING FOR MISSLE

BACKGROUND OF THE INVENTION

Many types of missiles use a variety of aerodynamic surfaces for lift, control and stability. Depending on the manner in which a missile is stowed or launched, it is often necessary to make some or all of the surfaces foldable or retractable to reduce the overall size of the missile.

Some types of aerodynamic surfaces are in the form of fins which fold against the missile body and may be curved to fit closely around the body. Since these usually curve in the same direction to fit in the available space, they do not provide symmetrical lift when erected and are suitable only for directional stability. Such folding fins are often not flush with the body and can cause considerable drag at high speeds.

Other types fold or retract into the body and occupy internal space, which restricts the space available for payload. For high speed flight the surfaces need not be very large and some compromises are acceptable. For low speed flight, on the order of 200 to 300 ft/sec, the surface area must be fairly large to be effective and this poses problems of stowage. Flexible wings have been used, in which a membrane is supported by a spar of strut which swings out from the body. The single layer of fabric normally used, while stretched out by its supporting member, is subject to aerodynamic flutter at certain speeds and airflow conditions. When used as a lifting wing the fabric bows upwardly to form an undercambered single surface airfoil, which is reasonably stable under consistent loads. However, sudden changes in load conditions can cause the wing to collapse or flutter.

It is desirable, therefore, to have a wing which will fold into a small space in the manner of a flexible wing and has simple support structure, yet which will resist fluttering and maintain aerodynamic stability under varying load and airflow conditions.

SUMMARY OF THE INVENTION

The retractable wing structure described herein enables a large area wing to be stowed in a small space within the body of a missile and, when extended, provides a stable wing which is resistant to flutter. The wing is a double walled hollow structure of flexible fabric, supported by a leading edge strut and a trailing edge strut which are spring loaded to extend when released. Air trapped between the fabric walls acts as a cushion or damper against external pressure variations due to aerodynamic loads and so prevents flutter from developing.

The wing folds into a slot in the outer wall of the missile and requires a space little more than the depth of the supporting struts. Multiple wings spaced around the missile are all held in the stowed position by a simple latch or retainer, which can also be used to secure covers over the wing openings. When the latch is released, all the wings extend automatically.

The primary object of this invention, therefore, is to provide a new and improved self-erecting fabric wing for missiles and the like.

Another object of this invention is to provide a self-erecting fabric wing which contains an air pocket to damp out aerodynamic fabric.

Another object of this invention is to provide a self-erecting fabric wing which can be stowed in a very small space within a missile body.

A further object of this invention is to provide a self-erecting fabric wing which is readily adaptable to a variety of missiles.

Other objects and advantages will be apparent in the following detailed description, taken in conjunction with the accompanying drawings, in which.

DESCRIPTION OF THE PREFERRED EMBODIMENTS

Figure 1:
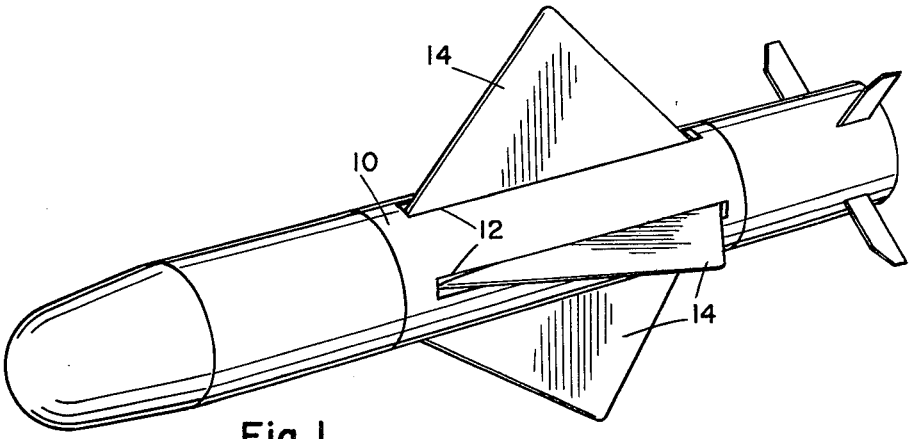
FIG. 1 is a perspective view of a typical missile incorporating the wings.
Figure 2:
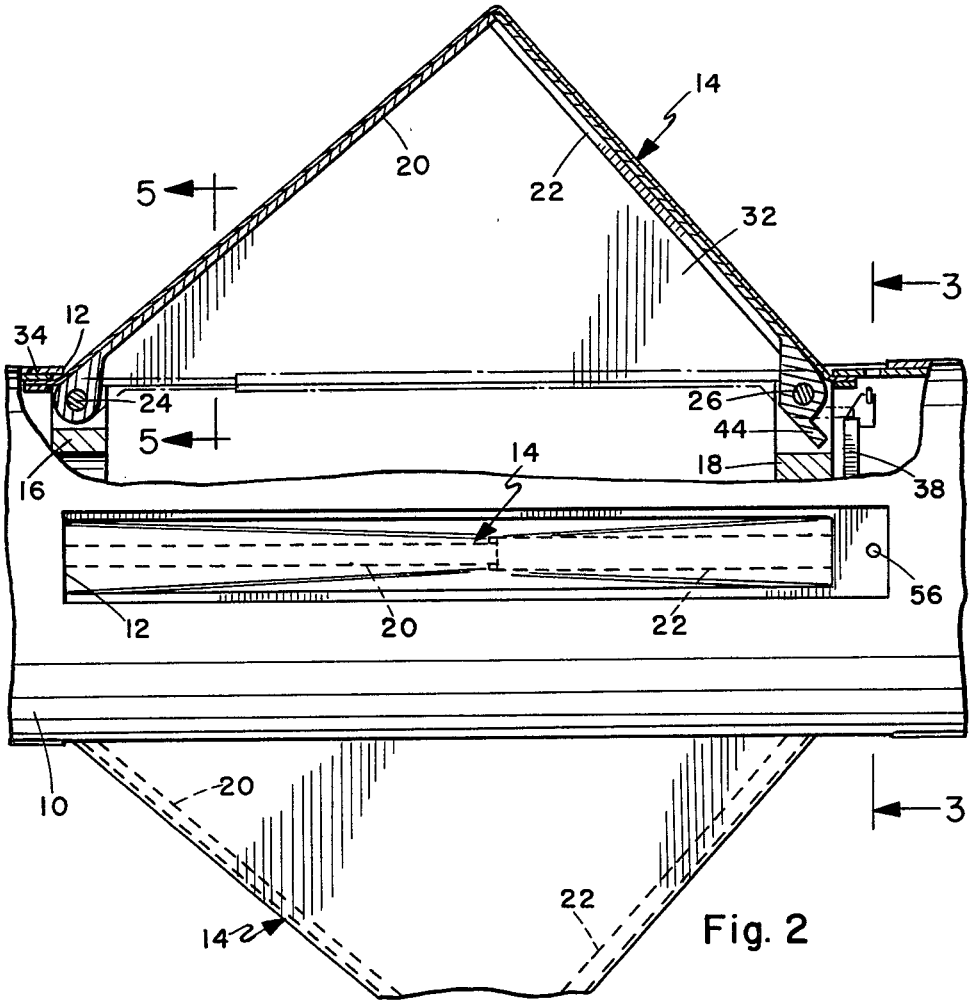
FIG. 2 is an enlarged side elevation view of the wing carrying section of the missile, with portions cut away.
Figure 3:
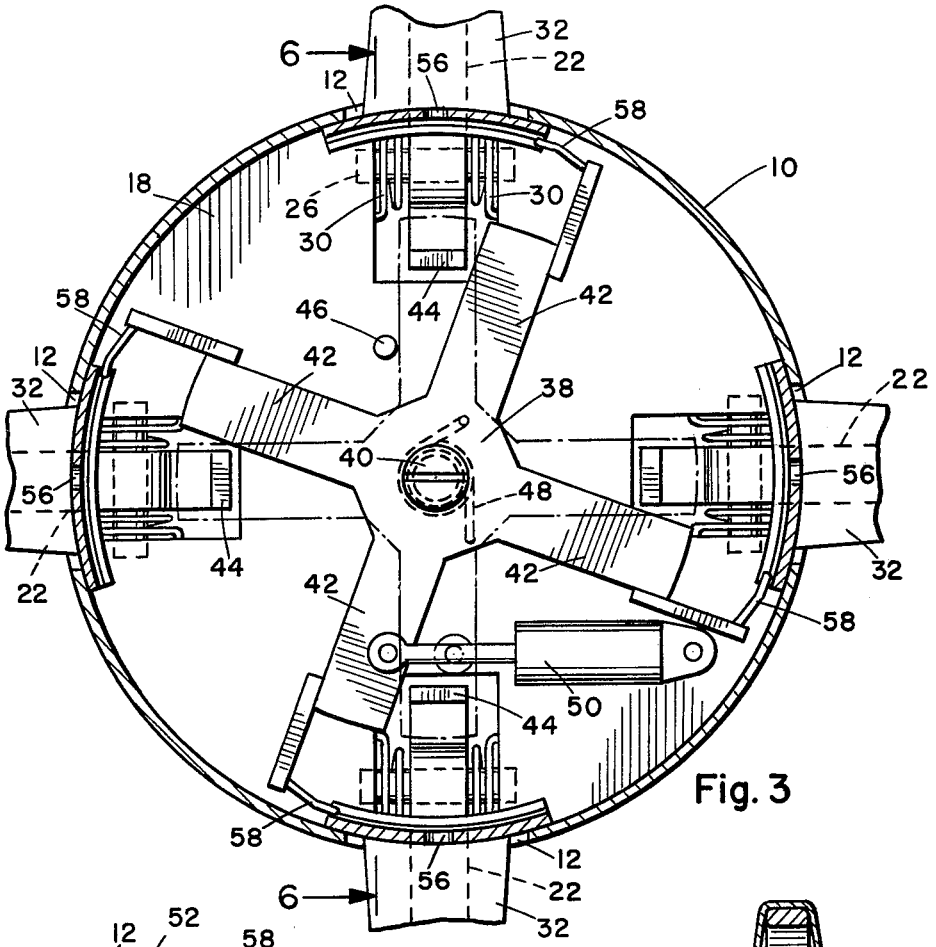
FIG. 3 is an enlarged sectional view taken on line 3—3 of FIG. 2.
Figure 4:
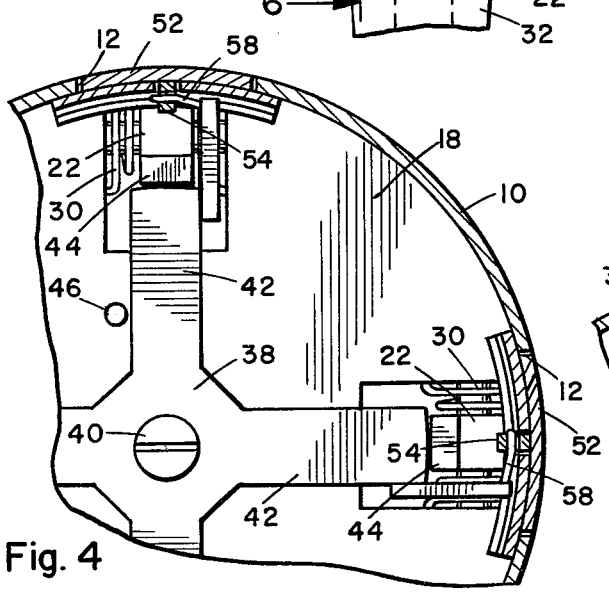
FIG. 4 is a sectional view similar to FIG. 3, but with the wings stowed and latched.
Figure 5:
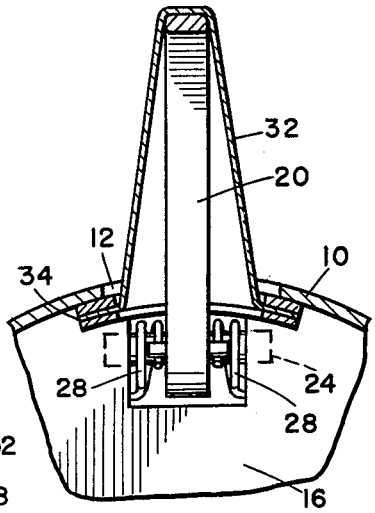
FIG. 5 is an enlarged sectional view taken on line 5—5 of FIG. 2.
Figure 6:
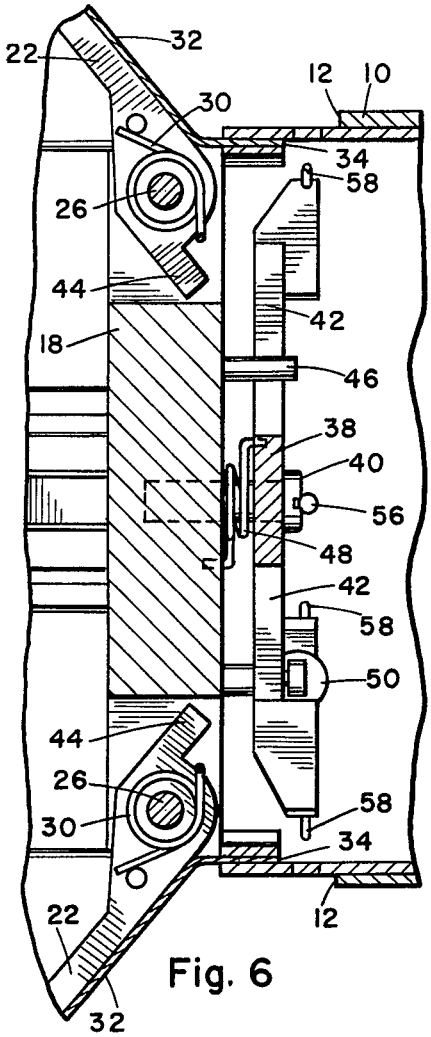
FIG. 6 is a sectional view taken on line 6—6 of FIG. 3.
Figure 7:
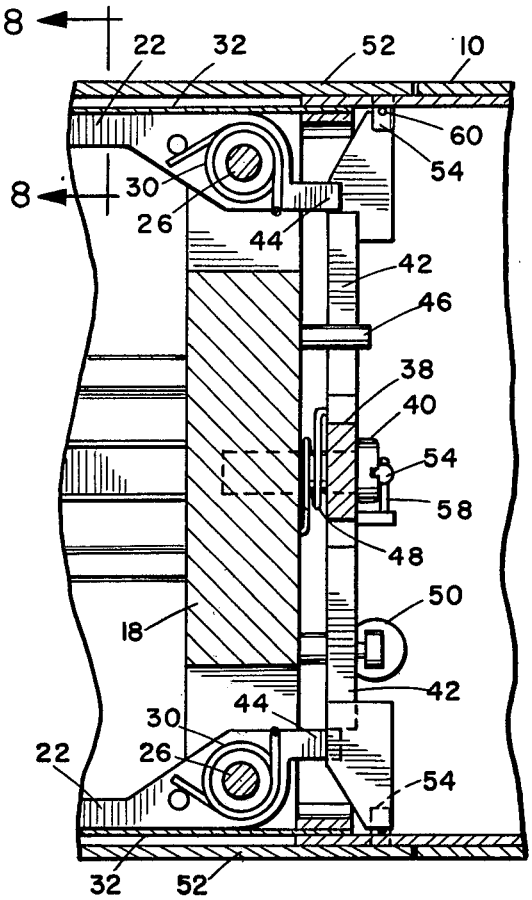
FIG. 7 is a sectional view similar to FIG. 6, but with the wings stowed and latched.

The missile illustrated in FIG. 1 has a cylindrical body 10 with circumferentially spaced longitudinal slots 12, from which the self-erecting wings 14 extend. A cruciform arrangement of four wings is shown, but any suitable number can be installed. The missile can have any required configuration of warhead, guidance and propulsion means to suit a specific operation. The wings are identical and the structure and mechanism for one wing will be described.

Wing 14 is mounted between a forward bulkhead 16 and a rear bulkhead 18, which are part of the structure of body 10, the wing having a leading edge strut 20 and a trailing edge strut 22. The leading edge strut 20 is pivotally attached at its forward end to bulkhead 16 by a hinge pin 24, to swing radially outwardly from the body. Trailing edge strut 22 is similarly pivotally attached to bulkhead 18 by a hinge pin 26. In the configuration illustrated in FIGS. 2–8, trailing edge strut 22 is a channel member and leading edge strut 20 is a bar member which, in the retracted position, lies inside the channel, as in FIG. 8. Leading edge strut 20 is biased outwardly by at least one torsion spring 28 and trailing edge strut 22 is biased outwardly by at least one torsion spring 30.

Figure 8:
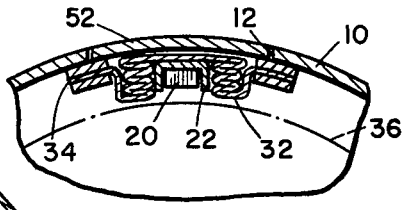
FIG. 8 is a sectional view taken on line 8—8 of FIG. 7.

Wing cover 32 for the wing 14 is formed by a double walled hollow pocket of flexible fabric material, such as reinforced plastic, plastic or rubber impregnated woven fabric, or the like, preferably air impervious. The base edge 34 of the wing cover 32 is peripherally secured to the inside edge of slot 12 by any suitable means, such as adhesive, heat sealing, rivets, or other fastners. In the erect position the cover 32 is stretched tight and supported by the spring loaded struts 20 and 22 at their full extension. The triangular shape is simple and effective, but it should be understood that other shapes could be used with appropriate strut structure. In the retracted position, as shown in FIG. 8, the cover 32 is folded in any suitable manner along the sides of the struts. The cover could also be folded under the struts and held in place by the retracted struts. The retracted wing requires very little space and is confined to the outer periphery of the body, leaving a maximum internal payload zone indicated in broken line at 36.

Various techniques may be used to hold the wings in retracted position and release them when required. Examples include a sleeve or strip off covers which could be pulled away by a drogue parachute or a timed release mechanism. One simple arrangement illustrated uses a mechanical latch to release all the wings simultaneously and also to release covers from slots 12 if required.

The latch mechanism includes a latch spider 33 rotatably mounted on an axial post 40 on the rear of bulkhead 18, the spider having a radial arm 42 for each wing. Each trailing edge strut 22 has a rearwardly projecting latch lug 44 which, in the retracted position, rests on the outer end of the respective arm 42, as in FIGS. 4 and 7. The latch spider 38 is biased to this latched position and held against a stop pin 46 by a torsion spring 48 around post 40.

Latch spider 38 is rotated through a small angle to the unlatched position by an actuator 50 mounted on bulkhead 18 and coupled to one arm 42. The actuator is a short stroke single action device and may be powered by a solenoid, a spring, fluid pressure, a squib, or other such means, controlled by a timer or command signal depending on the type of missile. When the latch spider rotates, the arms 42 move out from under the latch lugs 44, allowing the spring loaded struts to snap out, as in FIGS. 3 and 6.

In each slot 12 is a door or cover 52, at the rear end of which is a locking stud 54 projecting inwardly through a hole 56 in body 10. On the end of each arm 42 is a circumferentially extending locking pin 58, which fits through a pin hole 60 in the stud 54, as in FIG. 4, and holds the cover in place. The front end of the cover may be held by any suitable means, such as a lip fitting under the edge of slot 12, not shown. When the latch spider is rotated to the unlatched position, the locking pins 58 will be withdrawn from studs 54, allowing the covers 52 to be ejected by the extending wings.

Figure 9:
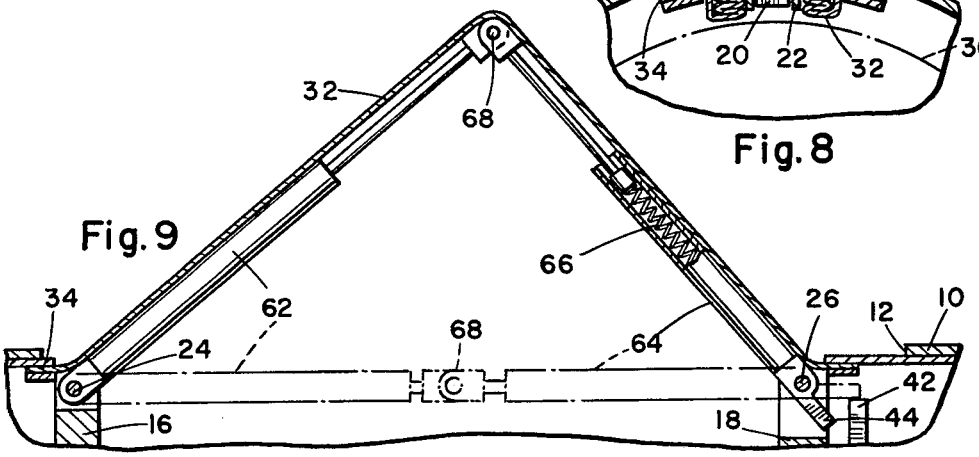
FIG. 9 is a view similar to a portion of FIG. 2, showing an alternative wing supporting strut arrangement.

An alternative strut structure is illustrated in FIG. 9, in which the leading edge strut 62 and the trailing edge strut 64 are telescopic and biased by linear extension means such as spring 66. The two struts are pivotally interconnected by a coupling 68 and are coaxial in the retracted position, as indicated in broken line. The other structure is as described above and the parts are similarly numbered.

Figure 10:
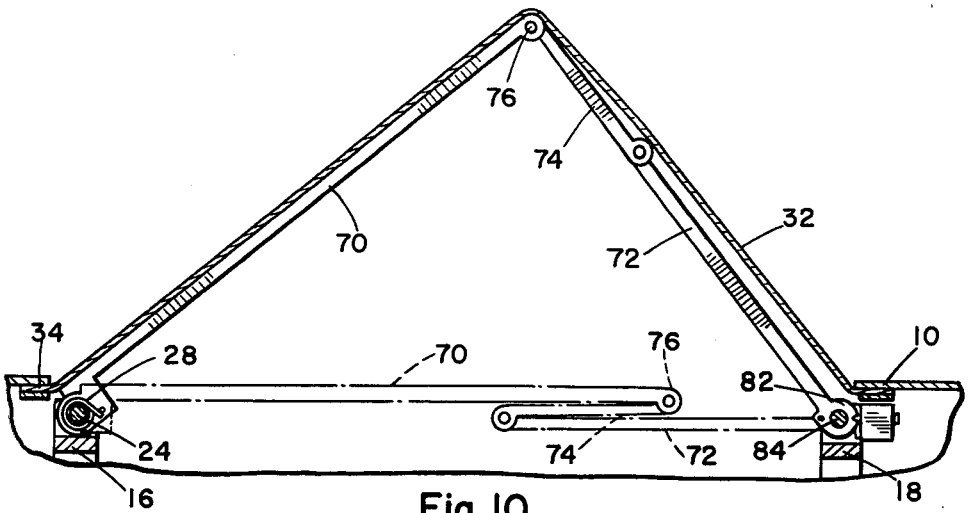
FIG. 10 is a view similar to FIG. 9, showing an alternative folding strut.
Figure 11:
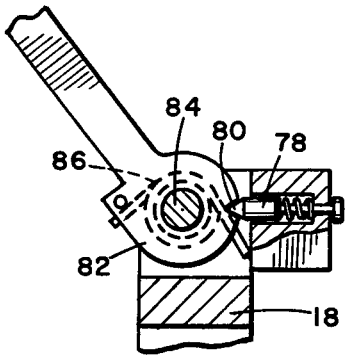
FIG. 11 is an enlarged view of a portion of FIG. 10, showing a latch for holding the strut open.

A further type of strut arrangement is illustrated in FIGS. 10 and 11. The leading edge strut 70 is a rigid bar member hinged to bulkhead 16 by a hinge pin 24 and biased outwardly by a spring 28. Trailing edge strut 72, however, has a hinged link 74 with a pivotal end connection 76 to the end of leading edge strut 70. In the retracted position, indicated in broken line, the link 74 folds between the struts and allows them to fold flat in overlapping position while remaining connected.

To hold the erected struts rigid the trailing edge strut is provided with a lock, which includes a spring loaded lock pin 78 engaging a notch 80 in the enlarged hub 82 on the strut, as in FIG. 11. The hub 82 is rotatable on a hinge pin 84 in the bulkhead 18 and a spring 86 biases the strut outwardly to the locked position. The arrangement is adaptable to the latch and release mechanism described above, or to any other suitable release means.

While dual struts are shown for supporting both the leading and trailing edges of the wing, it should be understood that for some purposes a single strut may be sufficient.

In the erected position the wing encloses an air pocket which acts as a cushion against the air flow on both sides of the wing. Uneven flow or turbulence which would cause fluttering of a single surface flexible wing will be damped out by the air pocket. This makes it possible for relatively large, light weight wings to be used on a missile where storage space is very limited. The air pocket will, of course, be at the ambient pressure inside the missile, which will be sufficient for most purposes.

Figure 12:
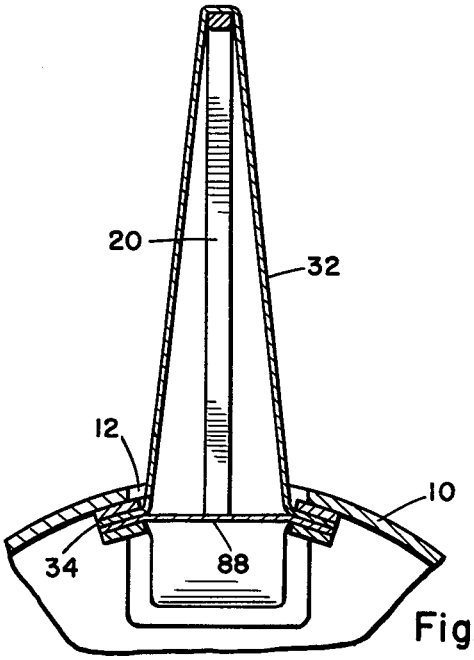
FIG. 12 is a sectional view similar to FIG. 5, showing a sealed wing arrangement.

If additional rigidity is needed, the wing can be closed by an inner sealing panel 88 secured to the base edge 34, as in FIG. 12. This allows the wing to be pressurized to a reasonable degree, or at least to maintain the air pocket without pressure fluctuation.

Having described our invention, we claim:

1. In a missile having an elongated body, the body having an outer wall with a plurality of circumferentially spaced, longitudinally extending slots therein, a retractable, self-erecting wing mounted in each slot, each wing comprising:

a wing supporting strut assembly comprised of at least one elongated strut element operably mounted in the slot, said strut assembly being adapted to move from a retracted position completely within said outer wall of said body to an extended position projecting from the body;

biasing means urging said strut assembly toward the extended position;

a wing member of flexible fabric material in the form of a double walled pocket conforming substantially to the extended configuration of the strut assembly and movable therewith, said wing member being secured to said outer wall around the periphery of the slot and enclosing said strut assembly between the fabric walls and within the pocket of said double walled pocket;

retaining means operably mounted in the body for releasably holding, against the force of said biasing means, the wing in a retracted position with the strut assembly and wing member folded within the slot;

and extension means operably mounted on the body for releasing said retaining means thereby extending the wing pursuant to the force of said biasing means.

2. The structure of claim 1, wherein said wing member is of air impervious material and contains an air pocket therein in the extended position.

3. The structure of claim 2, wherein said wing member has an inner seal around the periphery of the slot, enclosing and sealing the air pocket therein.

4. The structure of claim 1, wherein said strut assembly includes a leading edge strut pivotally mounted in the body at a forward end of the slot, and a trailing edge strut pivotally mounted in the body at the rear end of the slot.

5. The structure of claim 4, wherein at least one of said struts is biased by said biasing means to swing outwardly from the body.

6. The structure of claim 5, wherein one of said struts is a channel member and the other strut is a bar member which seats in the channel member in the retracted position.

7. The structure of claim 5, wherein said struts are pivotally interconnected and one of the struts has a foldable link therein to fold with the struts overlapping.

8. The structure of claim 7, and including locking means for engaging and holding at least one of said struts in the extended position.

9. The structure of claim 5, wherein said struts have telescopic portions, the telescopic portions being pivotally interconnected.

10. The structure of claim 5, wherein said retaining means includes a latch lug on one of said struts, and a latch arm for engagement with the latch lug to hold the associated strut in the retracted position, and actuating means for releasing the latch arm from the lug.

11. The structure of claim 5, wherein said retaining means includes a latch lug extending from said trailing edge strut, a latch member mounted in the body and having arms for simultaneously engaging the latch lugs of all the wings when said latch member is in the latched position and said wings are in the retracted position, and actuating means for moving said latch member to an unlatched position.

12. The structure of claim 11, and including a cover removably mounted in each of said slots, said latch member having means for engaging and holding said covers in the slots in the latched position.

13. The structure of claim 11, wherein said latch member is biased to the latched position.

14. The structure of claim 1, wherein said flexible fabric material of said wing member is under tension between said slot and said strut assembly when said wing is in the extended position.

* * * * *